US006055712A

United States Patent [19]

Thoma

[11] Patent Number: 6,055,712

[45] Date of Patent: May 2, 2000

[54] METHOD OF MANUFACTURING AIR TEXTURED THREADS

[75] Inventor: Wilfried Thoma, Waldkirch-Kollnau, Germany

[73] Assignee: Guetermann AG, Gutach-Breisgau, Germany

[21] Appl. No.: 09/116,293

[22] Filed: Jul. 16, 1998

[30] Foreign Application Priority Data

Jul. 18, 1997 [DE] Germany ..... 197 30 977

[51] Int. Cl.[7] ..... D02G 1/00

[52] U.S. Cl. ..... 28/220; 28/258; 28/271

[58] Field of Search ..... 28/217, 240, 271, 28/246, 258, 220; 57/210, 227, 228, 3, 6, 310, 350, 351, 246, 247, 362, 908

[56] References Cited

U.S. PATENT DOCUMENTS

| | | | |
|---|---|---|---|
| 4,025,595 | 5/1977 | Mirhej | 28/271 |
| 4,437,301 | 3/1984 | Eschenbach et al. | 28/271 |
| 4,972,563 | 11/1990 | Wheeler | 28/271 |
| 5,581,858 | 12/1996 | Curran et al. | 28/258 |
| 5,593,777 | 1/1997 | Jacob et al. | 57/247 |
| 5,802,836 | 9/1998 | Curran et al. | 28/271 |

FOREIGN PATENT DOCUMENTS

| | | |
|---|---|---|
| 0718425A1 | 6/1996 | European Pat. Off. . |
| 37 20 237 A1 | 1/1989 | Germany . |
| 3720237A1 | 1/1989 | Germany . |
| 3008910C2 | 1/1990 | Germany . |
| 3834139A1 | 4/1990 | Germany . |
| 30 08 910 | 9/1990 | Germany . |
| 44 24 547 A1 | 1/1995 | Germany . |
| 4424547A1 | 1/1995 | Germany . |
| 44 01 513 A1 | 7/1995 | Germany . |
| 4401513A1 | 7/1995 | Germany . |
| 44 30 633 A1 | 3/1996 | Germany . |

OTHER PUBLICATIONS

Patent Abstracts of Japan vol. 014, No. 310 (C–0736), Jul. 4, 1990 (Jul. 04, 1990) & JP 02 104733 A (Toyobo Co Ltd), Apr. 17, 1990 (Apr. 17, 1990), Abstract.

*Primary Examiner*—Amy B. Vanatta
*Attorney, Agent, or Firm*—Townsend and Townsend and Crew LLP

[57] ABSTRACT

Method of manufacturing air textured threads comprising at least one ground thread and at least one effect thread, wherein at least the ground thread is drafted before it is fed, together with the effect thread, to a texturizing unit and wherein the texturized yarn consisting of ground and effect threads is heated. A ground thread is used with a fineness between 80 and 200 dtex and an effect thread is used with a fineness between 60 and 165 dtex, with the effect thread being finer than the ground thread.

51 Claims, 1 Drawing Sheet

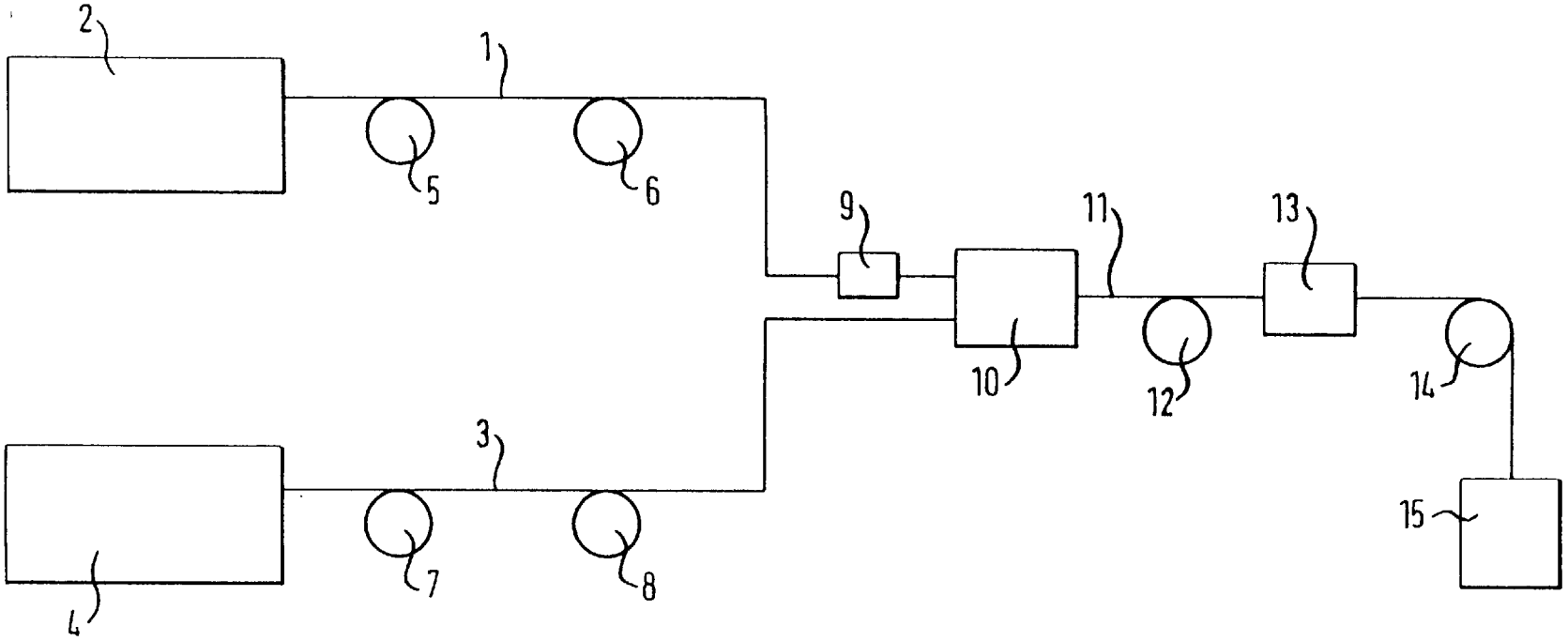
2
1
5
6
9
10
11
12
13
14
15
4
3
7
8

METHOD OF MANUFACTURING AIR TEXTURED THREADS

BACKGROUND OF THE INVENTION

The invention relates to a method of manufacturing air textured threads comprising at least one ground thread and at least one effect thread, wherein at least the ground thread is drafted before it is fed together with the effect thread to a texturizing unit and wherein the texturized yarn consisting of ground and effect threads is heated.

DESCRIPTION OF THE PREFERRED EMBODIMENTS

Such methods exploit the effect that the ground thread which is drafted prior to the texturizing shrinks less than the effect thread during the heating of the texturized yarn which takes place after the texturizing unit. This has the consequence that loops formed during the texturizing of the effect thread contract during the named heating, whereby the thread ultimately obtains a relatively smooth surface in the desired manner.

In accordance with the prior art, the described method was previously only used for the manufacture of threads having a coarse fineness (tex), i.e. for the manufacture of relatively thick threads.

BRIEF SUMMARY OF THE INVENTION

An object of the invention is to so further develop the method of the initially named kind that thin, very fine threads can also be manufactured with adequate strength.

In accordance with the invention this object is satisfied in that a ground thread is used with a fineness between 80 and 200 dtex and an effect thread is used with a fineness between 60 and 165 dtex, with the effect thread being finer than the ground thread.

Through the use of ground and effect threads with the named finenesses, it is, for example, possible to make threads with a fineness lying under 200 dtex, and with a strength above 30 cN/tex without problem. In particular finenesses of the thread of approximately 130 dtex can be achieved, with strengths between 36 and 38 cN/tex being simultaneously ensured. The elongation of threads manufactured in accordance with the invention amounts, for example, to between 11 and 12%, i.e. the texturized thread can be stretched in length by 11 to 12% without breaking.

Through the method of the invention, very fine threads can thus be manufactured, which have both a high strength and also a high uniformity and with a high freedom from faults.

It is preferred when a ground thread is used with a fineness between 140 and 160 dtex and/or an effect thread is used with a fineness between 70 and 90 dtex. Ground and/or effect threads can each have between 36 and 144 filaments.

In order to favor the effect of the greater shrinkage of the effect thread compared with the ground thread after the texturizing unit, it is of advantage when the ground thread is drafted before the texturizing unit by a factor of 1.8 to 2.6, in particular by a factor of 2 to 2.4. Furthermore, it is of advantage if the effect thread is also drafted before the texturizing unit in addition to the ground thread, with the draft of the effect thread preferably being smaller than the draft of the ground thread. The effect thread can, for example, be drafted by a factor of 1.5 to 1.9, and in particular by a factor of 1.6 to 1.8.

It is furthermore advantageous if the ground thread and/or the effect thread is/are heated prior to the texturizing unit.

The ground thread can in this respect be more strongly heated than the effect thread, with temperatures between 150° C. and 240° C., and in particular between 160° C. and 220° C. being appropriate with respect to the heating of the ground thread.

With regard to the heating of the effect thread, temperatures between 100° C. and 200° C., and in particular between 140° C. and 180° C. are, for example, appropriate.

For the technical realization of the method of the invention, the ground thread and/or the effect thread can in each case be guided prior to the texturizing unit over two sequential galettes. The drafting of the ground thread and/or the effect thread can then, for example, be brought about by different drive speeds of two sequential galettes, with the front galette in the forwarding direction running faster than the rear galette. In addition, or alternatively to the drafting, a heating of the ground and/or effect threads can also be brought about by means of the galettes, in that at least one of the galettes respectively associated with the ground and/or effect threads is heated. In this connection the galettes can be heated to the temperatures already named above.

In order to prevent slippage occurring between the galettes and the ground and/or effect threads, the threads can each be wrapped between 5 and 20 times, in particular between 6 and 10 times, helically around a galette, so that the friction forces between the galettes and the thread are sufficiently high. Through the said wrapping a situation is also achieved, when the galettes are heated, that the threads remain in contact with the respective galettes sufficiently long, for adequate heat to be transferred from the galette to the threads.

In accordance with an advantageous embodiment of the invention, the texturized yarn is drafted after the texturizing unit. This drafting can, for example, take place by a factor of between 0.95 and 1.1, in particular between 1.01 and 1.05. The drafting preferably takes place in such a way that precisely that length of the texturized yarn which is just being heated is also simultaneously subjected to after-drafting. In this way a situation can be prevented in which the texturized yarn contracts too much during the heating. Specifically, a situation is achieved with an after-drafting factor greater than 1, in which the ground thread component of the texturized yarn is extended during the heating process. With an after-drafting factor smaller than 1, it is ensured that the ground thread components can shrink by the after-drafting factor at most.

The shrinkage of the ground thread component of the texturized yarn is thus restricted by the said after-drafting, and the loops formed by the effect thread can contract or pull together in the desired manner through the heating.

The heating of the texturized yarn after the texturizing unit is preferably effected in such a way that the temperature of the texturized yarn amounts in the named region to between 200 and 300° C., in particular to between 210° C. and 260° C.

It is of advantage when the texturized yarn is also guided over two sequential galettes, with the drafting of the texturized yarn in this case taking place analogously to the drafting of the threads prior to the texturizing unit.

With respect to the texturized yarn it is also appropriate, for the above named reasons, when the texturized yarn wraps around each of the galettes between 5 and 20 times, and in particular between 6 and 10 times.

When carrying out the method of the invention, the texturized yarn can leave the texturizing unit with a speed between 300 m/min and 500 m/min, in particular with 400 m/min.

In order to enable the formation of adequate loops of the effect thread during the texturizing process, it is of advantage when the speed of supply of the effect thread is higher than the speed of supply of the ground thread, so that in the finished thread the length of the processed effect thread is ultimately greater than the length of the processed ground thread.

It is preferred when both the effect thread and the ground thread are supplied at a speed which lies above the speed with which the texturized yarn leaves the texturizing unit.

The speed of supply of the ground thread preferably lies between 4% and 8%, and in particular approximately 6% above the speed with which the texturized yarn leaves the texturizing unit.

The speed of supply of the effect thread preferably lies between 14% and 20%, and in particular between 16% and 18% above the speed with which the texturized yarn leaves the texturizing unit.

The texturizing unit, which is preferably formed as a texturizing nozzle, can, for example, be operated with a pressure between 6 and 14 bar.

It is of advantage when the ground thread is treated with water prior to the texturizing unit, with the water throughput amounting, for example, to between 0.1 l/h and 1 l/h, and in particular to approximately 0.2 l/h. Normal drinking water can, for example, be used for the water treatment of the ground thread, with the drinking water having previously been passed through an active carbon filter.

The ground thread and/or the effect thread can consist of polyester, polyamide, polyamide 6, polyamide 6.6, polyamide 4.6, polyethylene and/or viscose.

Instead of using only one ground thread and one effect thread it is alternatively possible to supply one ground thread and two effect threads, or two ground threads and one effect thread, or two each of the ground and effect threads to the texturizing unit.

In order to ultimately produce a sewing thread from the thread manufactured in accordance with the invention, the texturized yarn can be twisted, in particular after it has been heated. The twist amounts, for example, to between 150 and 600 and in particular to between 300 and 500 turns per meter.

Protection is also claimed in the context of the present application for yarns or sewing threads manufactured in accordance with the invention.

Further preferred embodiments of the invention are set forth in the subordinate claims.

BRIEF DESCRIPTION OF THE DRAWING

The invention will be described in the following with reference to an embodiment and to the single Figure, which shows in schematic illustration the individual stations of an apparatus for carrying out the method of the invention.

The ground thread 1 is drawn off from a supply reel 2 during the operation of the apparatus. In analogous manner, the effect thread 3 is drawn off from a second supply reel 4.

The ground thread passes from the supply reel 2 to a first galette 5, around which the ground thread 1 is wrapped several times in helical manner. From the first galette 5, the ground thread 1 is tensioned to a second galette 6, around which it is likewise wrapped several times. In analogous manner, the effect thread 3 is guided via a third galette 7 and a forth galette 8.

Following the second galette 6, the ground thread 1 passes to a wetting station 9, at which it is wetted with water.

The wetted ground thread 1 and also the effect thread coming from the fourth galette 8 are thereafter jointly supplied to a texturizing nozzle 10, in which the two threads 1, 3 are swirled together.

The texturized yarn 11 leaving the texturizing unit is supplied via a fifth galette 12 to a heating device 13, from where the heated texturized yarn 11 passes to a sixth galette 14.

The texturized yarn 11 is again wrapped several times around each of the galettes 12 and 14.

From the sixth galette 14, the texturized yarn is led to a winding-up reel 15.

The described apparatus can, for example, be operated in the following mode, with the named parameters naturally being variable in the above named ranges.

The ground thread 1 is drawn off from the supply reel 2 with a speed of approximately 240 m/min and supplied to the first galette 5. In corresponding manner, the effect thread 3 is drawn off from the supply reel 4 with a speed of approximately 310 m/min and supplied to the third galette 7.

The ground thread has a fineness of approximately 160 dtex, while the effect thread has a fineness of approximately 90 dtex.

The second galette runs faster by a factor of 1.8 than the first galette 5, whereby a corresponding draft of the ground thread 1 results. The fourth galette 8 runs by a factor of 1.5 faster than the third galette 7, whereby a corresponding draft of the effect thread 3 also results here.

The second galette 6 is heated to a temperature of 240° C., so that a corresponding heating of the ground thread 1 is brought about. In corresponding manner the fourth galette 8 is designed for a temperature of 200° C. for the heating of the effect thread. The first galette 5 and also the third galette 7 are both not heated.

In the wetting station 9 the drafted and heated ground thread is wetted with water, with a water throughput of 0.7 l/h being used here.

The texturizing nozzle 10 is operated at an air pressure of approximately 7 bar.

The swirled and texturized yarn 11 is drafted between the fifth galette 12 and the sixth galette 14 by a factor of 1.01, which is brought about in that the sixth galette 14 runs faster than the fifth galette 12 by a corresponding factor.

In the heating device 13 arranged between the two galettes 12, 14, the texturized yarn 11 undergoing the drafting process is heated to a temperature of approximately 300° C.

The texturized yarn leaves the texturizing unit 10 with a speed of approximately 400 m/min and is taken up by the winding reel 15 with approximately the same speed.

I claim:

1. A method of manufacturing air textured threads having at least one ground thread and at least one effect thread, the method comprising selecting a ground thread which has a fineness between 80 and 200 dtex and an effect thread with a fineness between 60 and 165 dtex so that the effect thread is finer than the ground thread, extending at least the ground thread, feeding the extended ground thread with the effect thread to a texturizing unit to form a textured yarn, and heating the texturized yam.

2. A method according to claim 1 wherein the step of selecting comprises selecting the ground thread so that it has a fineness between 140 dtex and 160 dtex.

3. A method according to claim 1 wherein the step of selecting comprises selecting the effect thread so that it has a fineness between 70 and 90 dtex.

4. A method according to claim 1 including providing at least one of the ground thread and the effect thread with between 36 and 144 filaments.

5. A method according to claim 1 wherein the step of extending comprises drafting the ground thread prior to its arrival at the texturizing unit to between 1.8 to 2.6 times its prior length.

6. A method according to claim 5 wherein the step of drafting comprises drafting the ground thread to between 2 to 2.4 times its prior length.

7. A method according to claim 1 wherein the step of extending comprises extending the effect thread by drafting it before its arrival at the texturizing unit.

8. A method according to claim 7 wherein extending the ground thread comprises drafting the ground thread by more than the effect thread prior to its arrival at the texturizing unit.

9. A method according to claim 7 wherein drafting the effect thread comprises drafting it to between 1.5 to 1.9 times its prior length.

10. A method according to claim 9 wherein drafting the effect thread comprises drafting it to between 1.6 to 1.8 times its prior length.

11. A method according to claim 1 comprising heating at least one of the ground thread and the effect thread upstream of the texturizing unit.

12. A method according to claim 11 including heating the ground thread more than the effect thread.

13. A method according to claim 11 including heating the ground thread to a temperature between 15020 C. and 24020 C.

14. A method according to claim 13 wherein heating the ground thread comprises heating it to a temperature between 160° C. and 220°.

15. A method according to claim 11 including heating the effect thread to a temperature between 100° C. and 200° C.

16. A method according to claim 15 including heating the effect thread to a temperature between 140° C. and 180° C.

17. A method according to claim 1 including guiding at least one of the ground thread and the effect thread over sequentially arranged galettes upstream of the texturizing unit.

18. A method according to claim 17 wherein the step of extending comprises drafting the at least one of the ground thread and the effect thread by varying the speed of the sequential galettes.

19. A method according to claim 17 including heating at least one of the ground thread and the effect thread by heating corresponding galettes.

20. A method according to claim 17 including heating the ground thread to a temperature between 150° C. and 240° C. and the effect thread to a temperature between 100° C. and 200° C. by correspondingly heating at least one galette contacted by the ground thread and at least one galette contacted by the effect thread.

21. A method according to claim 17 including wrapping at least one of the ground thread and the effect thread between 5 and 20 times about the galettes.

22. A method according to claim 21 wherein the step of wrapping comprises wrapping the at least one of the ground thread and the effect thread between 7 and 10 times about the galettes.

23. A method according to claim 1 including drafting the texturized yarn.

24. A method according to claim 23 including drafting the texturized yarn to between 0.95 to 1.1 times its prior length.

25. A method according to claim 23 wherein drafting the texturized yarn comprises drafting it to between 1.01 to 1.05 times its prior length.

26. A method according to claim 1 including heating the texturized yarn to a temperature between 200° C. and 300° C.

27. A method according to claim 26 including heating the texturized yarn to between 210° C. and 260° C.

28. A method according to claim 1 including guiding the texturized yarn over sequentially arranged first and second galettes.

29. A method according to claim 28 including drafting the texturized yam by driving the first and second sequential galettes at different speeds.

30. A method according to claim 28 wherein heating the texturized yam comprises heating the texturized yarn at a location between the first and second galettes.

31. A method according to claim 27 including wrapping the texturized yarn around the first and second galettes between 5 to 20 times.

32. A method according to claim 31 including wrapping the texturized yam between 6 to 10 times about the first and second galettes.

33. A method according to claim 1 including discharging the texturized yarn from the texturizing unit at a speed between 300 m/min and 500 m/min.

34. A method according to claim 33 including discharging the texturized yarn from the texturizing unit at a speed of approximately 400 m/min.

35. A method according to claim 33 including supplying the ground thread to the texturizing unit at a speed so that the ground thread is discharged from the texturizing unit at a speed between 4% and 8% above the speed at which it is supplied to the texturizing unit.

36. A method according to claim 35 including discharging the ground thread from the texturizing unit at a speed which is approximately 6% above the speed at which the ground thread is supplied to the texturizing unit.

37. A method according to claim 33 including supplying the effect thread to the texturizing unit at a speed so that the speed at which the effect thread is discharged from the texturizing unit is between 14% and 20% above the speed at which the effect thread is supplied to the texturizing unit.

38. A method according to claim 37 wherein the speed at which the effect thread is discharged from the texturizing unit is between 16% and 18% above the speed at which the effect thread is supplied to the texturizing unit.

39. A method according to claim 1 including operating the texturizing unit at a pressure of approximately 9 bar.

40. A method according to claim 1 including treating the ground thread with water prior to its arrival at the texturizing unit.

41. A method according to claim 40 including supplying water for treating the ground thread at a rate of between 0.2 l/h and 1 l/h.

42. A method according to claim 41 including supplying the water at a rate of approximately 0.25 l/h.

43. A method according to claim 1 wherein at least one of the ground thread and the effect thread comprises one of polyester, polyamide, polyamide 6, polyamide 6.6, polyamide 4.6, polyethylene and viscose.

44. A method according to claim 1 wherein the texturized yarn has at least two ground threads or effect threads, and including feeding the at least two ground threads or effect threads to the texturizing unit before they are formed into the texturized yarn.

45. A method according to claim 44 wherein feeding comprises one of feeding two ground threads and one effect thread and one ground thread and two effect threads to the texturizing unit.

46. A method according to claim 44 including feeding two ground threads and two effect threads to the texturizing unit.

47. A method according to claim 1 including twisting the texturized yarn to thereby produce sewing thread.

48. A method according to claim 47 wherein the step of twisting is performed after heating the texturized yarn.

49. A method according to claim 47 including twisting the texturized yarn between 160 and 600 turns per meter.

50. A method according to claim 49 including twisting the texturized yarn between 300 and 500 turns per meter.

51. A method of manufacturing air textured sewing yarn having at least one ground thread and at least one effect thread, the method comprising selecting a ground thread which has a fineness between 80 and 200 dtex and an effect thread with a fineness between 60 and 165 dtex so that the effect thread is finer than the ground thread, extending at least the ground thread, feeding the extended ground thread with the effect thread to a texturizing unit to form a textured sewing yarn, and heating the texturized sewing yarn.

* * * * *